US006935499B1

(12) United States Patent
Hooper

(10) Patent No.: US 6,935,499 B1
(45) Date of Patent: Aug. 30, 2005

(54) TOOL CADDY

(76) Inventor: Leslie E. Hooper, 2000 E. Marlboro Ave. Apt 102, Landover, MD (US) 20785

( * ) Notice: Subject to any disclaimer, the term of this patent is extended or adjusted under 35 U.S.C. 154(b) by 110 days.

(21) Appl. No.: 10/236,166

(22) Filed: Sep. 6, 2002

(51) Int. Cl.[7] ..... H65D 85/28
(52) U.S. Cl. ..... 206/373; 206/372
(58) Field of Search ..... 206/372, 373, 206/216; D9/308; D3/201, 234, 270, 321, D3/323, 327, 905; 220/9.4, 676, 213, 305; 150/105, 106, 107, 110; 190/102

(56) References Cited

U.S. PATENT DOCUMENTS 4,673,081 A * 6/1987 Habig et al. ..... 220/573
5,002,401 A 3/1991 Blackman
5,267,662 A * 12/1993 Hayes ..... 220/4.12
5,285,900 A * 2/1994 Swingler ..... 206/508
D360,977 S 8/1995 Katz
5,489,042 A * 2/1996 Ewald ..... 220/573
5,527,409 A 6/1996 Lanphier
5,653,337 A 8/1997 Cirigliano
5,834,083 A 11/1998 Pignataro, Jr.
5,894,914 A * 4/1999 Jubin ..... 190/119
6,041,716 A * 3/2000 Alibozek ..... 108/44
6,126,003 A 10/2000 Brouard
6,454,121 B1 * 9/2002 Kurtz et al. ..... 220/573
6,571,998 B2 * 6/2003 Godshaw et al. ..... 224/607

* cited by examiner

*Primary Examiner*—Mickey Yu
*Assistant Examiner*—J. Gregory Pickett
(74) *Attorney, Agent, or Firm*—Leonard & Proehl, Prof. L.L.C.

(57) ABSTRACT

A tool caddy for providing a tool carrier that is rugged and holds a large number of tools. The tool caddy includes a main tool storage unit having an upper opening into an interior and comprising a core section having a pair of side walls and a bottom wall extending between the side walls. A filler wall is mounted over the side wall opening of the core section with each of the filler walls being substantially coplanar with one of the side walls. A strap is mounted on the storage unit for suspending the storage unit from a user's body. In one preferred embodiment, the core section comprises a section of a tire, and a method of the invention includes forming the storage unit from a tire by cutting the side and perimeter tread walls of the tire at two locations to form the core section and mounting a filler wall over a portion of the side wall opening.

21 Claims, 4 Drawing Sheets

TOOL CADDY

BACKGROUND OF THE INVENTION

1. Field of the Invention

The present invention relates to tool containers and more particularly pertains to a new tool caddy for providing a tool carrier that is rugged and holds a large number of tools.

2. Description of the Prior Art

The use of tool containers is known in the prior art. More specifically, tool containers heretofore devised and utilized are known to consist basically of familiar, expected and obvious structural configurations, notwithstanding the myriad of designs encompassed by the crowded prior art which have been developed for the fulfillment of countless objectives and requirements.

In particular, the known tool containers are formed of rigid materials such as metal or stiff plastic, and are specially formed for the purpose of holding tools.

In these respects, the tool caddy according to the present invention substantially departs from the conventional concepts and designs of the prior art, and in so doing provides an apparatus primarily developed for the purpose of providing a tool carrier that is rugged and holds a large number of tools.

SUMMARY OF THE INVENTION

In view of the foregoing disadvantages inherent in the known types of tool containers now present in the prior art, the present invention provides a new tool caddy construction wherein the same can be utilized for providing a tool carrier that is rugged and holds a large number of tools.

To attain this, the present invention generally comprises a main tool storage unit having an upper opening into an interior and comprising a core section having a pair of side walls and a bottom wall extending between the side walls. A filler wall is mounted over the side wall opening of the core section with each of the filler walls being substantially coplanar with one of the side walls. A strap is mounted on the storage unit for suspending the storage unit from a user's body. In one preferred embodiment, the core section comprises a section of a tire, and a method of the invention includes forming the storage unit from a tire by cutting the side and perimeter tread walls of the tire at two locations to form the core section and mounting a filler wall over a portion of the side wall opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to form the tool caddy from inexpensive materials such as used vehicle tires. The tool caddy of the invention thus formed is relatively soft and flexible but retains sufficient structural rigidity to hold tools, and is thus easier to carry close to the body of the user without injuring the user's body.

The advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
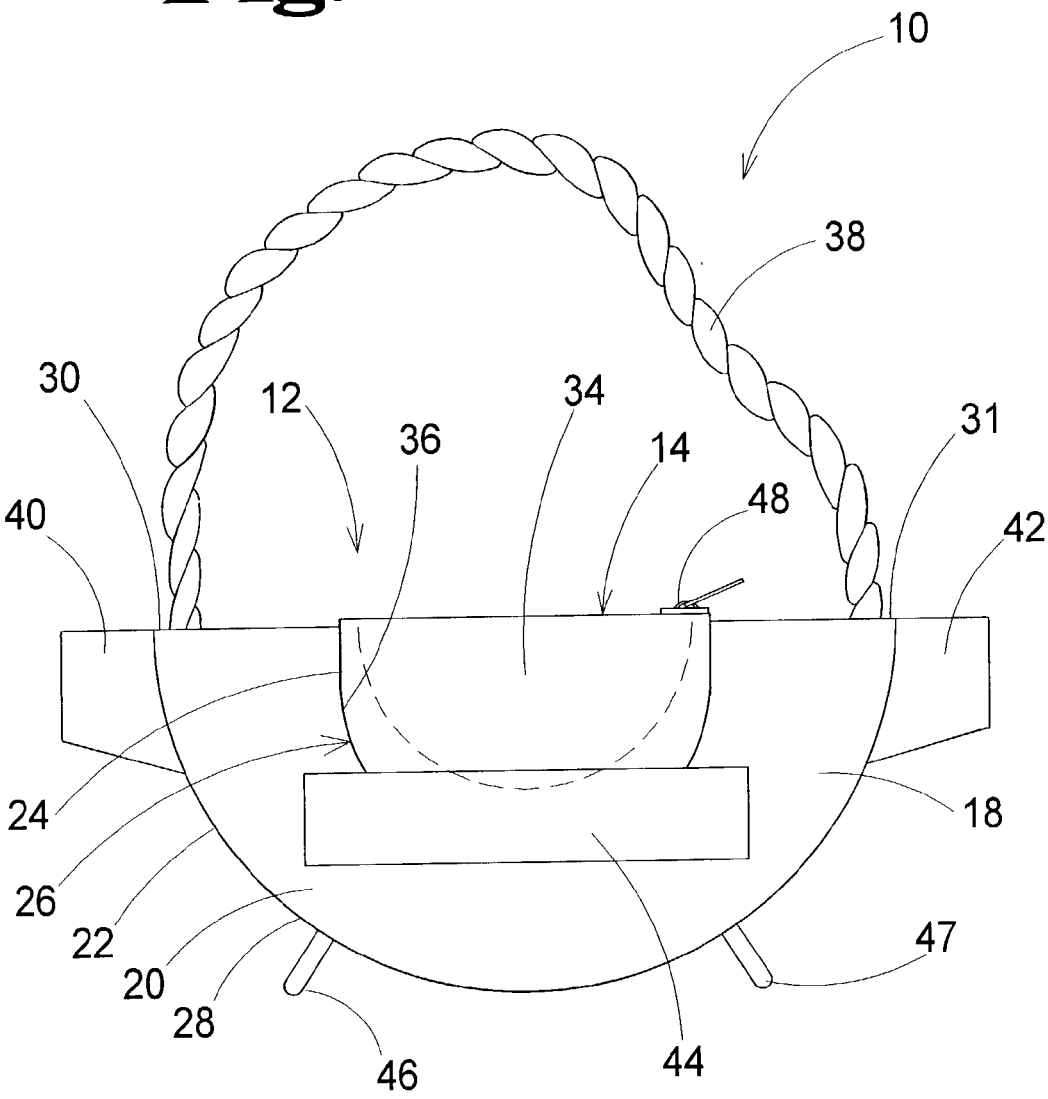
FIG. 1 is a schematic front view of a new tool caddy according to the present invention.
Figure 2:
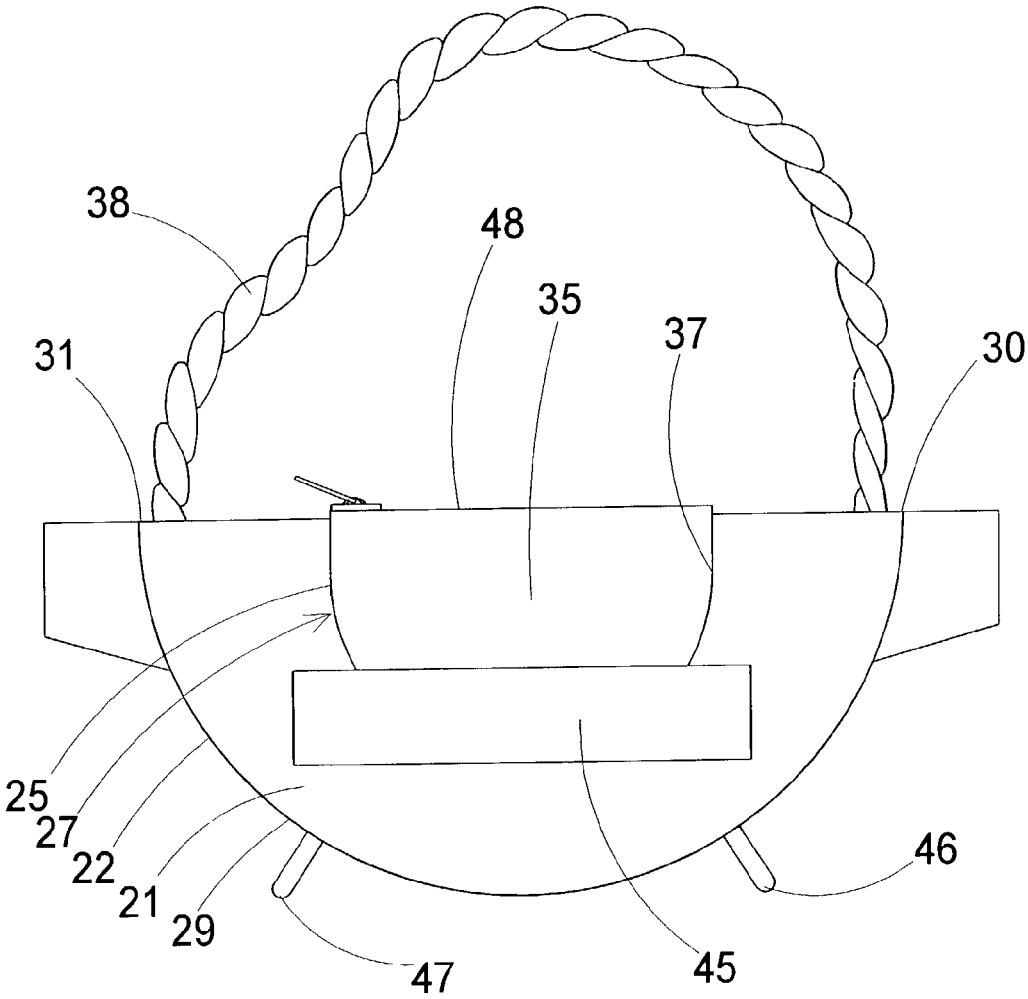
FIG. 2 is a schematic rear view of the present invention.
Figure 3:
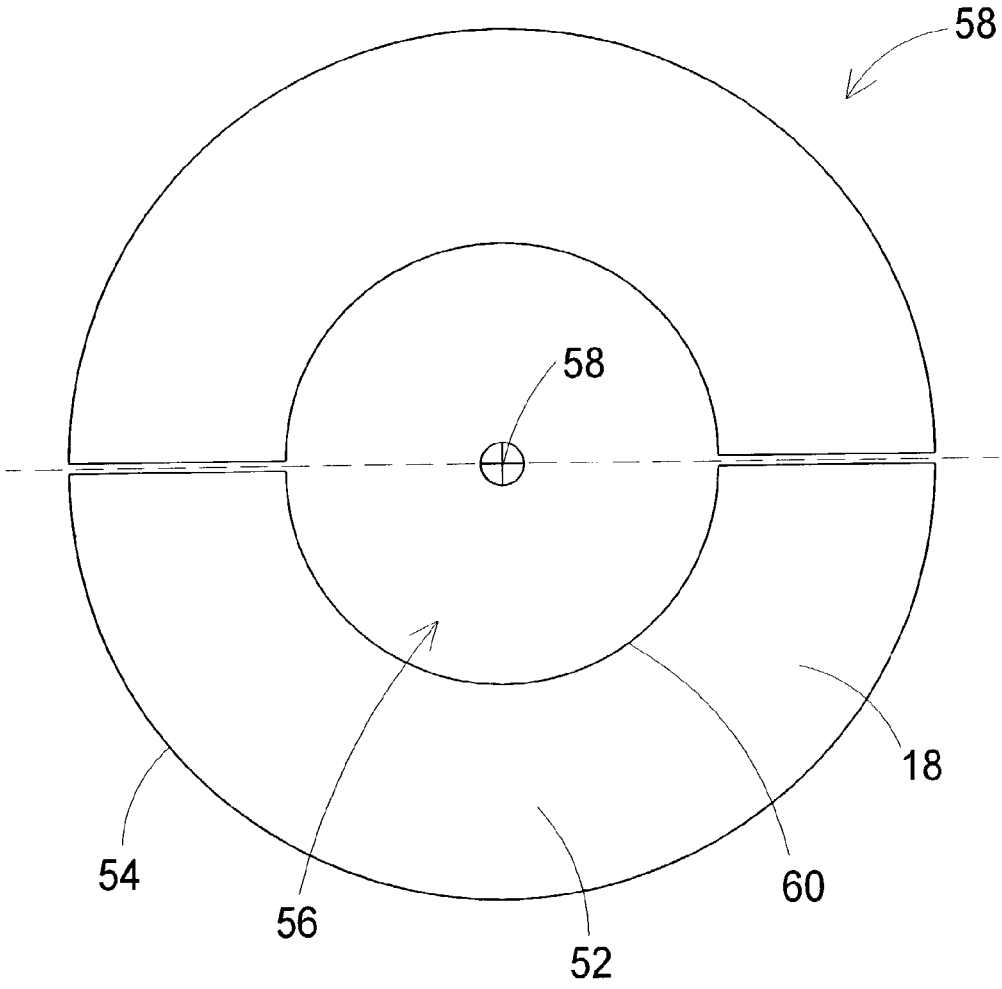
FIG. 3 is a schematic top view of a tire cut in a manner suitable for forming the tool caddy of the present invention.
Figure 4:
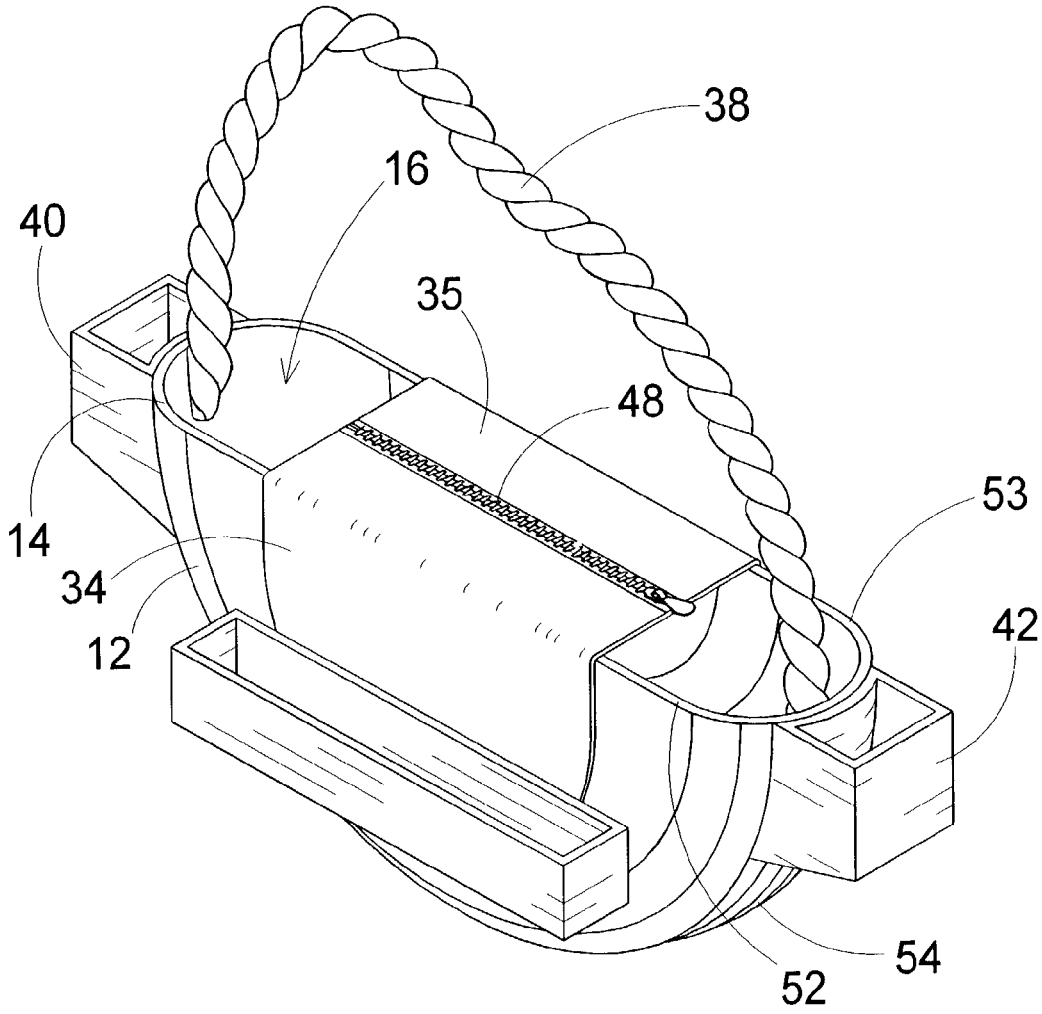
FIG. 4 is a schematic perspective view of the present invention.

With reference now to the drawings, and in particular to FIGS. 1 through 4 thereof, a new tool caddy embodying the principles and concepts of the present invention and generally designated by the reference numeral 10 will be described.

As best illustrated in FIGS. 1 through 4, one aspect of the invention contemplates a tool caddy system 10. The tool caddy system 10 of the invention comprises a main tool storage unit 12 for carrying tools. The main tool storage unit 12 has an upper opening 14 that opens into an interior 16 of the main tool storage unit, and tools and other items may be passed through the upper opening for placing them in, and retrieving them from, the interior of the main tool storage unit.

The main tool storage unit 12 may include a core section 18 having a pair of side walls 20, 21 and a bottom wall 22 that extends between the side walls 20, 21. A portion of the upper opening 14 may be defined by the side 20, 21 and the bottom 22 walls. The side walls 20, 21 may each have an inner perimeter edge 24, 25 that defines a side wall opening 26, 27 in each of the side walls. The side walls 20, 21 may each have an outer perimeter edge 28, 29 mounted on the bottom wall 22. The bottom wall 22 may have a pair of opposite end edges 30, 31, and the bottom wall 22 may have an arcuate shape between the opposite end edges 30, 31 such that an upper surface 32 of the bottom wall 22 is substantially concave upwards toward the interior 16 of the main tool storage unit 12.

The main tool storage unit may also include a filler wall 34, 35 mounted over each of the side wall openings 26, 27 of the core section 18. Each of the filler walls 34, 35 may have an upper edge 36, 37 that may be substantially coplanar with the end edges 30, 31 of the core section 18. Each of the filler walls 34, 35 may be substantially semicircular in perimeter shape. A portion of the perimeter edge 36, 37 of each of the filler walls 34, 35 may be mounted to a portion of the inner perimeter edge 24, 25 of the side wall 20, 21.

A strap 38 may be mounted on the main tool storage unit 12 for supporting and suspending the main tool storage unit from a body of a user, and the most preferred straps are elongate and flexible. In one embodiment of the invention, the strap 38 is formed from a length of rope.

A first pouch 40 may be mounted on the main tool storage unit 12 for holding an object such as a tape measure. The first pouch 40 may be located on the bottom wall 22 of the core section, and may be positioned adjacent to a first one 30 of the end edges of the core section 18. A second pouch 42 may be mounted on the main tool storage unit 12 for holding miscellaneous items such as tools. The second pouch 42 may be located on the bottom wall 22 of the core section 18, and may be positioned adjacent to a second one 31 of the end edges of the core section. A first holder 44 may be mounted on the main tool storage unit 12 for holding a relatively elongate tool such as a hacksaw. The holder 44 may be located on one of the filler walls 34, 35 of the main tool storage unit 12. The holder 44 may be positioned adjacent to the upper edge 36, 37 of the filler wall 34, 35. A second holder 45 may be mounted on the opposite filler wall from the first holder 44, and may be suitable for receiving and holding a hammer.

Optionally, a pair of feet 46, 47 may be mounted on the main tool storage unit 12, and may be located on an outer surface 48 of the bottom wall. One foot 46 of the pair of feet may be positioned between a central location on the bottom wall and a first one 30 of the end edges, and a second foot 47 of the pair of feet may be positioned between the central location on the bottom wall and a second one 31 of the end edges.

A closure 48 may be provided for selectively closing a gap between the upper edges 36, 37 of the filler walls 34, 35 of the main tool storage unit 12, and thereby close the upper opening into the interior. The closure 48 selectively joins the upper edges 36, 37 of the filler walls together, and in one embodiment of the invention comprises a zipper.

One aspect of the invention contemplates a method of forming the tool caddy system 10 which is especially useful for forming the main tool storage unit tool in an easy and inexpensive manner, and permits the beneficial use of used vehicle tires that can prolong the usefulness of the tires after their use on a vehicle is no longer feasible. In the method, a tire 50 is provided that has a pair of side walls 52, 53 and a perimeter tread wall 54 that extends between the side walls. Each of the side walls 52, 53 defines a side wall opening 56, and the tire has an axis of rotation 58 that is surrounded by the side wall opening 56. The side wall opening 56 is defined by an inner perimeter edge 60 on the side wall 52, 53.

The main tool storage unit 12 may be formed from the tire by cutting the side 52, 53 and perimeter tread 54 walls of the tire 50 at two locations on the tire to form the core section 18 with portions of the side walls 52, 53 of the tire forming the side walls 20, 21 of the core section and a portion of the perimeter tread wall 54 of the tire forming the bottom wall 22 of the core section. In one embodiment of the invention, the tire may be severed in a plane that extend through the axis of rotation of the tire such that the core section includes a semicircular section of the tire, with the opposite end edges of the side and perimeter tread walls lying in the plane and a portion of the side wall opening being positioned on each side of the plane. Optionally, the tire may be cut at locations that are less than 180 degrees away from each other, although the capacity of the interior will be compromised.

A filler wall 34 may be mounted over the portion of the side wall opening on the core section, and the upper edge of the filler wall may extend substantially coplanar with the end edges of the core section. A perimeter edge of each of the filler walls may be mounted to a portion of the inner perimeter edge of the side wall in a suitable manner, such as by chemical bonding with an adhesive, or by mechanical connection such as, for example, sewing or tacking or stapling.

As desired, a strap, a first pouch, a second pouch, a first holder, a second holder, a pair of feet, and a closure means may be mounted on the main tool storage unit.

In use, the user may easily place relatively larger tools in the interior of the main tool storage unit, and relatively smaller tools, or tools for which quick access is desired, may be located in the various pouches and holders on the exterior of the main tool storage unit.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool caddy system for carrying tools, comprising:

a main tool storage unit for carrying tools, the main tool storage unit having an upper opening into an interior of the main tool storage unit, the main tool storage unit comprising:

a core section having a pair of side walls and a bottom wall extending between the side walls, the side walls each having an inner perimeter edge defining a side wall opening, a portion of the upper opening being defined by the side and bottom walls; and a filler wall mounted over each of the side wall openings of the core section, the filler wall including a lower portion extending across the side wall opening and an upper portion extending from the lower portion toward the other side wall of the core section, the upper portion of the filler wall having an upper edge;

a strap mounted on the main tool storage unit for supporting and suspending the main tool storage unit from a body of a user; and a closure mounted on the upper portions of the filler walls and being configured to selectively secure together the filler walls along the upper edges of the filler walls.

2. The system of claim 1 wherein the core section of the main tool storage unit comprises a section of a tire.

3. The system of claim 1 wherein the side walls each have an outer perimeter edge mounted on the bottom wall.

4. The system of claim 1 wherein the bottom wall is arcuate between the opposite end edges such that an upper surface of the bottom wall is concave upwards toward the interior of the main tool storage unit.

5. The system of claim 1 wherein an upper edge of the filler wall is substantially coplanar with the end edges of the core section.

6. The system of claim 1 wherein a perimeter edge of each of the filler walls is mounted to a portion of the inner perimeter edge of the side wall.

7. The system of claim 1 wherein the strap has opposite ends each mounted on opposite ends of the core section.

8. The system of claim 1 additionally comprising a first pouch mounted on the main tool storage unit for holding a tape measure.

9. The system of claim 8 wherein the first pouch is located on the bottom wall of the core section adjacent to a first one of the end edges of the core section.

10. The system of claim 8 additionally comprising a second pouch mounted on the main tool storage unit for holding miscellaneous items.

11. The system of claim 10 wherein the second pouch is located on the bottom wall of the core section adjacent to a second one of the end edges of the core section.

12. The system of claim 1 additionally comprising a holder mounted on the main tool storage unit for holding a hacksaw, the holder being located on one of the filler walls of the main tool storage unit.

13. The system of claim 12 wherein the holder is positioned adjacent to a lower portion of the filler wall.

14. The system of claim 1 additionally comprising a pair of feet mounted on the main tool storage unit and located on an outer surface of the bottom wall.

15. A tool caddy system for carrying tools, comprising;

a main tool storage unit for carrying tools, the main tool storage unit having an upper opening into an interior of the main tool storage unit, the main tool storage unit comprising:

a core section having a pair of side walls and a bottom wall extending between the side walls, the side walls each having an inner perimeter edge defining a side wall opening, a portion of the upper opening being defined by the side and bottom walls; and a filler wall mounted over each of the side wall openings of the core section, each of the filler walls being substantially coplanar with a respective one of the side walls;

a strap mounted on the main tool storage unit for supporting and suspending the main tool storage unit from a body of a user; and a closure means for selectively closing a gap between the upper edges of the filler walls of the main tool storage unit.

16. The system of claim 15 wherein the closure means comprises a zipper.

17. A tool caddy system for carrying tools, comprising:

a main tool storage unit for carrying tools, the main tool storage unit having an upper opening into an interior of the main tool storage unit, the main tool storage unit comprising:

a core section having a pair of side walls and a bottom wall extending between the side walls, a portion of the upper opening being defined by the side and bottom walls, wherein the side walls each have an inner perimeter edge defining a side wall opening, the side walls each have an outer perimeter edge mounted on the bottom wall;

wherein the bottom wall having a pair of opposite end edges, the bottom wall being arcuate between the opposite end edges such that an upper surface of the bottom wall is concave upwards toward the interior of the main tool storage unit;

wherein the core section comprises a section of a tire;

a filler wall mounted over each of the side wall openings of the core section, an upper edge of the filler wall being substantially coplanar with the end edges of the core section, each of the filler walls being substantially semicircular, a perimeter edge of each of the filler walls being mounted to a portion of the inner perimeter edge of the side wall;

a strap mounted on the main tool storage unit for supporting and suspending the main tool storage unit from a body of a user, the strap being formed of a length of rope;

a first pouch mounted on the main tool storage unit for holding a tape measure, the first pouch being located on the bottom wall of the core section, the first pouch being positioned adjacent to a first one of the end edges of the core section;

a second pouch mounted on the main tool storage unit for holding miscellaneous items, the second pouch being located on the bottom wall of the core section, the second pouch positioned adjacent to a second one of the end edges of the core section;

a holder mounted on the main tool storage unit for holding a hacksaw, the holder being located on one of the filler walls of the main tool storage unit, the holder being positioned adjacent to a lower portion of the filler wall;

a pair of feet mounted on the main tool storage unit, the pair of feet being located on an outer surface of the bottom wall, one foot of the pair of feet being positioned between a central location on the bottom wall between the end edges and a first one of the end edges and a second foot of the pair of feet being positioned between the central location on the bottom wall and a second one of the end edges; and a closure means for selectively closing a gap between the upper edges of the filler walls of the main tool storage unit, the closure means selectively joining the upper edges of the filler walls, the closure means comprising a zipper.

18. A method of forming a tool caddy system, including:

providing a tire having a pair of side walls and a perimeter tread wall extending between the side walls, each of the side walls defining a side wall opening, the tire having an axis of rotation surrounded by the side wall opening, the side wall opening being defined by an inner perimeter edge on the side wall;

forming a main tool storage unit from the tire, including;

cutting the side and perimeter tread walls of the tire at two locations on the tire to form a core section with an upper opening in communication with the side wall opening; and mounting a filler wall over a portion of each of the side wall openings on the core section to create an interior for the main tool storage unit with an upper opening; and extending an upper portion of each of the filler walls across the upper opening to permit adjacent positioning of upper edges of the filler walls.

19. The method of claim 18 wherein the step of cutting includes severing the tire in a plane including the axis of rotation of the tire such that the core section includes a semicircular section of the tire.

20. The method of claim 18 wherein the step of forming includes forming a closure on the respective upper edges of the filler wall of each side wall opening of the main tool storage unit to permit selective closing of a gap between the filler walls.

21. The system of claim 1 wherein each of the filler walls extends approximately half of a distance across the upper opening of the core section.

* * * * *